US007625230B2

(12) United States Patent
Boerner

(10) Patent No.: US 7,625,230 B2
(45) Date of Patent: Dec. 1, 2009

(54) APPARATUS TO ASSIST IN REMOVING AN ELECTRICAL PLUG FROM A SOCKET

(76) Inventor: Sean T. Boerner, 13907 Wetherfield La., Cypress, TX (US) 77429

( * ) Notice: Subject to any disclaimer, the term of this patent is extended or adjusted under 35 U.S.C. 154(b) by 0 days.

(21) Appl. No.: 12/281,984

(22) PCT Filed: Feb. 7, 2006

(86) PCT No.: PCT/US2006/004277

§ 371 (c)(1),
(2), (4) Date: Sep. 6, 2008

(87) PCT Pub. No.: WO2006/086380

PCT Pub. Date: Aug. 17, 2006

(65) Prior Publication Data

US 2009/0042425 A1 Feb. 12, 2009

(51) Int. Cl.
*H01R 13/00* (2006.01)

(52) U.S. Cl. ..... 439/484; 439/160; 439/923

(58) Field of Classification Search ..... 439/923, 439/484, 160, 152

See application file for complete search history.

(56) References Cited

U.S. PATENT DOCUMENTS 1,749,623 A * 3/1930 Zinman ..... 439/484
5,454,731 A * 10/1995 Dickie ..... 439/484
5,516,305 A * 5/1996 Haluska ..... 439/484

* cited by examiner

*Primary Examiner*—Ross N Gushi
(74) *Attorney, Agent, or Firm*—The Dickinson Law Offices; David B. Dickinson

(57) ABSTRACT

A strap (110, 210, 410) connected from one lateral side to the opposing lateral side of a non-conductive plate (120, 220, 420) disposed on the prongs (443, 444, 445) of an electrical plug 440 to permit easy removal of the electrical plug 440 from a socket for elderly or infirm individuals by applying force to the strap (110, 210, 410). The non-conductive plate 120 has preformed openings (123, 124, 125), which can each include a portion that is incurvate with respect to the opening for insertion of the electrical prongs therethrough. A slidable body (101-104; 201-204; 401-404) may be utilized with the strap (110, 210, 410) to retain the strap at a desired location on a power cord 430 or provide support for a power cord 430. A slidable body (101-104; 201-204; 305-306; 401-404) may be colored to aid in identifying a power cord 430 or appliance connected thereto.

17 Claims, 2 Drawing Sheets

APPARATUS TO ASSIST IN REMOVING AN ELECTRICAL PLUG FROM A SOCKET

INTRODUCTION

The present invention relates to an electrical plug removal apparatus; more specifically, to a readily-accessible strap mechanism connected to an electrical plug to assist in applying force to remove an electrical plug from an electrical socket.

Electrical plugs can sometimes be difficult to extract from sockets, especially for older people with arthritis or weak hands. Additionally, sockets on power strips are often so dense that it is difficult to extract a single electrical plug from a socket without pulling on the power cord itself or disrupting other electrical plugs from the power strip. Further, some power cords are connected to the electrical plug from the side to permit the low profile plug to lay close the adjacent socket plate face. In these cases, the electrical cord is near parallel to the wall when the socket is in the wall, thereby making the electrical plug difficult to extract. The attachment of an accessible loop into which a person can insert his or her fingers to leverage the removal force on the electrical plug, without the concurrent squeezing action around the plug or without pulling on the electrical conductor cord attached to the plug, permits ready removal of the electrical plug from a socket with a minimum of inconvenience and effort.

Most electrical appliances include warnings about the danger of disconnecting an appliance from the electrical socket by pulling on a power cord. This device assists in removing electrical plugs from sockets by applying the force to the electrical plug itself, yet seemingly offering the convenience of pulling on the power cord itself.

SUMMARY OF INVENTION

One embodiment of an apparatus for removing an electrical plug from a socket can include a strap with a first end and a second end, and a non-conductive plate having a first lateral edge connected to the first end of the strap and an opposing second lateral edge connected to the second end of the strap and providing a plurality of preformed openings for insertion of a plurality of respective prongs of the electrical plug through the non-conductive plate. At least one of the preformed openings can include a portion of an interior surface that is incurvate with respect to the opening. A strap can have a first end disposed through the first aperture, a second end disposed through the second aperture, and the first and the second ends of the strap connected to form a continuous loop.

An apparatus for removing an electrical plug from a socket can include a non-conductive plate having a first aperture adjacent to a first lateral edge of the plate, a second aperture adjacent to an opposing second lateral edge of the plate, and a plurality of preformed openings for insertion of a plurality of respective prongs of the electrical plug through the non-conductive plate, and a strap disposed through the first and the second aperture forming a continuous loop. A non-conductive plate can be polypropylene.

A first section and a second section of the strap can each extend between the first aperture and the second aperture and lie adjacent along substantially an entire length of the strap. A length of the first section of the strap and a length of the second section of the strap can be substantially equal. The first and the second sections of the strap can lie adjacent along substantially the entire length of the strap when the non-conductive plate is disposed between the electrical plug and the socket. The strap can be a flexible, non-conductive strap with a circular cross-section.

At least one of the preformed openings of the apparatus can be a four-sided opening with at least one side being incurvate relative to the four-sided opening. At least one set of opposing sides can be incurvate relative to the four-sided opening. At least one of the preformed openings can be a multiple-sided opening with at least one side being incurvate with respect to the multiple-sided opening.

In another embodiment, an apparatus for removing an electrical plug from a socket can include at least one slidable body with a longitudinal bore, the first and the second sections of the strap extending through the longitudinal bore. At least one slidable body can be a colored bead with a longitudinal bore.

The apparatus can include a power cord with a first end and a second end having the electrical plug connected thereto, the plurality of respective prongs of the electrical plug disposed through the non-conductive plate, and the power cord disposed between the first and the second sections of the strap. A first slidable body with a longitudinal bore can be disposed adjacent an exterior surface of the power cord and a second slidable body with a longitudinal bore can be disposed adjacent an opposing exterior surface of the power cord. The first and the second sections of the strap can extend through the longitudinal bore of the first slidable body and the longitudinal bore of the second slidable body.

A third slidable body with a longitudinal bore and a fourth slidable body with a longitudinal bore can be used. The first and the second sections of the strap can extend through the longitudinal bore of the third slidable body and the longitudinal bore of the fourth slidable body. The third slidable body can be disposed adjacent the first aperture of the non-conductive plate and the fourth slidable body can be disposed adjacent the second aperture of the non-conductive plate.

A second strap forming a continuous loop can be disposed around the power cord between the first end and the second end. The second strap can extend through a longitudinal bore of a fifth slidable body and a first and a second section of the second strap can extend through a longitudinal bore of a sixth slidable body. The second strap can be disposed adjacent to either end of the power cord. The sixth slidable body can be disposed adjacent an exterior surface of the power cord to retain the second strap at a desired location on the power cord.

An exterior surface of the first, the second, the third, the fourth, the fifth, and/or the sixth slidable body can be similarly colored to aid in identifying the power cord.

In another embodiment, an apparatus for removing an electrical plug from a socket can include a non-conductive plate having a first aperture adjacent to a first lateral edge of the plate, a second aperture adjacent to an opposing second lateral edge of the plate, and a plurality of preformed openings for insertion of a plurality of respective prongs of the electrical plug through the non-conductive plate, and a vinyl, or similar material, strap. The strap can have a rectangular or substantially rectangular cross-section. The strap can have ends that are disposed through the respective apertures in the non-conductive plate. Each end of the strap can be looped through an aperture and affixed to itself by cooperative elements attached to adjacent sections, for example, hook-and-loop fasteners, rivets, or snaps. Multiple cooperative elements, for example, a plurality of either male or female elements of a snap connector, can be placed along the ends of the strap so that the length of the strap can be adjusted therewith.

In the middle of the strap, where a power cord may lay, a shorter second strap can be attached to the first strap to align the strap with the power cord. One side of the second strap can be attached to the first strap by either a single rivet or snap that can allow the second strap to swivel relative to the first strap. The opposite side of the second strap can be attached to the first strap by a snap so that the second strap could be removed from around the power cord, so that the apparatus for removing an electrical plug from a socket can be attached or detached from the power cord.

DETAILED DESCRIPTION OF THE DRAWINGS

DETAILED DESCRIPTION OF THE INVENTION

Figure 1:
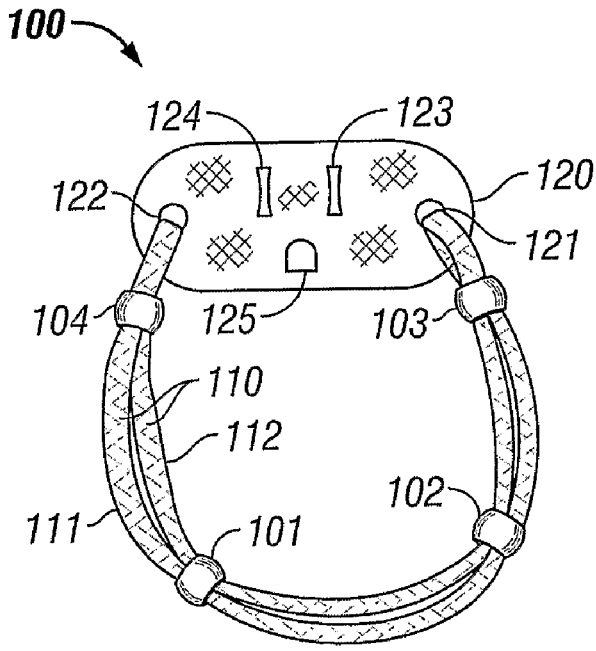
FIG. 1 is a perspective view of one embodiment of the present invention fabricated with a strap attached to a thin non-conductive plate.

As shown in FIG. 1, one embodiment of an apparatus 100 for removing an electrical plug from a socket includes a looped cord forming a strap 110 attached to a non-conductive plate 120 through a first 121 and a second aperture 122 adjacent a respective lateral edge of the plate 120. To form the strap 110, an end of the strap can be disposed through the first 121 and second apertures 122 and the ends joined by any means known in the art to create a continuous loop. The apertures (121, 122) can be any style or size known in the art and can be spaced appropriately from a respective edge of the plate 120 to withstand the forces encountered during plug removal with the strap 110 of the apparatus 100.

Figure 4:
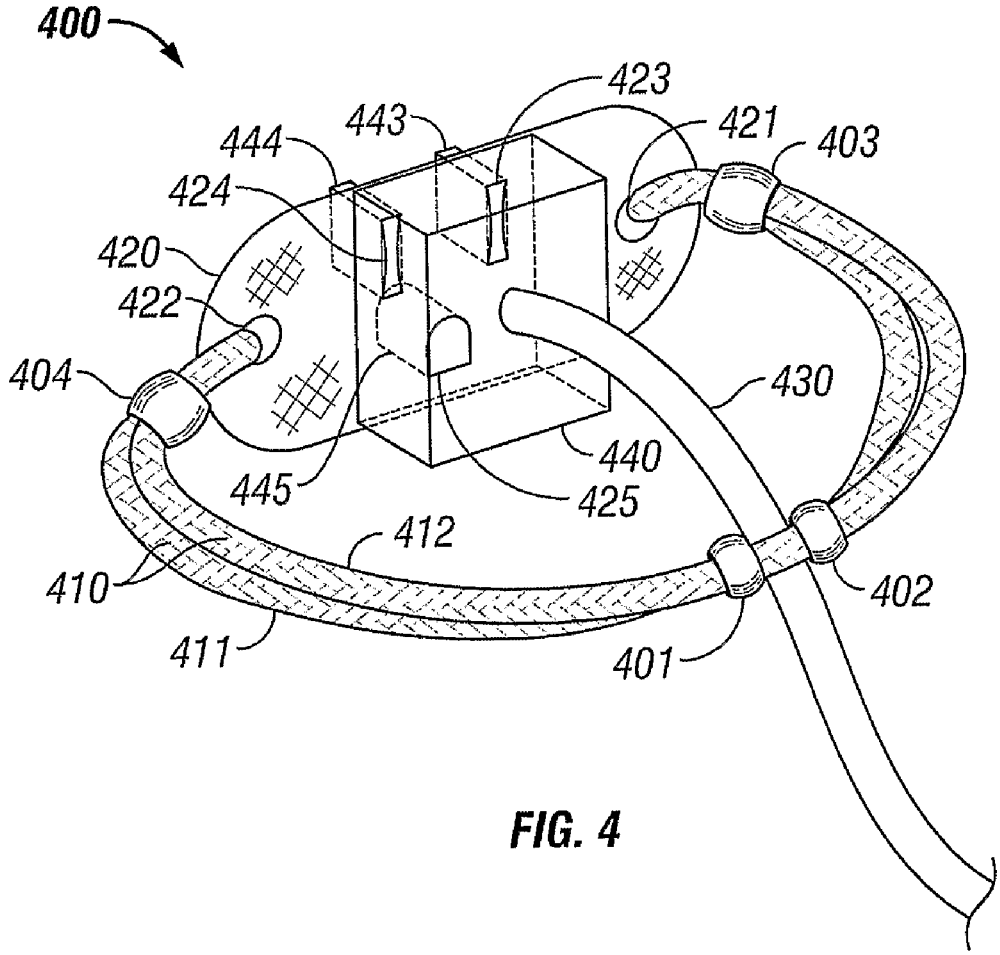
FIG. 4 is a perspective view showing one embodiment of the invention used with an electrical plug connected to a power cord which is disposed between the first and second sections of a strap.

The strap 110 allows a user to grasp the strap 110 and tug it to remove the electrical plug from the socket. The strap 110 can be composed of mesh, rope, cord, twine, yarn, ribbon, leather, plastic, fiberglass, or a variety of materials. It can consist of one or more strands. It can be a flexible material and/or non-conductive. It can have a circular cross-section. Preferably, the strap 110 is a material that is capable of being folded on itself or is otherwise flexible. In the embodiment shown in FIG. 1, a first 111 and a second 112 section of the strap 110 lie adjacent each other. This allows a user to have twice the contact area as opposed to applying force to only one of the sections (111 or 112) of the strap 110. Typically, the first 111 and second 112 sections of the strap 110 are substantially equal lengths when lying adjacent as shown. This can aid in keeping either section (111, 112) of the strap 110 from being disposed between the interconnection of electrical plug, apparatus 100, and socket, which can be a safety hazard. The strap 110 can be of a material with memory such that the sections (111, 112) remain in this overlapping state after installation in the non-conductive plate 120, or the strap 110 can have various accoutrements, such as a slidable body (101, 102, 103, 104), to retain this substantially abutting form. The slidable bodies (101, 102, 103, 104) are illustrated as beads, but the invention is not so limited. The slidable bodies (101, 102, 103, 104) can also serve identification and/or support purposes as discussed below. The strap 110 can optionally be disposed around the power cord as shown in FIG. 4. The strap 110 can also have snaps or hook-and-loop fasteners (not shown) so that the user can removably attach the strap 110 to the non-conductive plate 120.

A non-conductive plate 120 can have a plurality of preformed openings (123, 124, 125) in said plate to allow slidable insertion over the respective conductor pins or prongs of an electrical plug (see FIG. 4). The non-conductive plate 120 is preferably thin to allow disposition between an electrical plug and a socket, thereby assisting in removal of the electrical plug from a socket. As the strap 110 is not disposed between the electrical plug and socket, the plate 120 may be thin, independent of the size or thickness of the strap 110 used. A non-conductive plate 120 is not limited to having rounded edges as shown in the figures. The plate 120 can be any size and/or shape desired. A non-conductive plate 120 can consist of a thin sheet of any non-conducting material; such as, but not restricted to plastic, polypropylene, polyester film, fiberglass, or any other non-conducting material that will not interfere with the operation of the electrical plug and socket. A non-conductive plate 120 can be flexible if so desired.

Although the plurality of preformed openings (123, 124, 125) are shown to allow the disposition of the typical U.S. style electrical plug with two flat blades and a ground pin, the invention is not so limited. The non-conductive plate 120 can have any type or number of preformed openings to accommodate the configuration of prongs of respective plugs from different countries or for differing types of electrical service, without departing from the spirit of the invention. The plurality of preformed openings (123, 124, 125) can be sized to allow use with more than one type of electrical plug or constructed for use with a specific type of electrical plug. For example, either or both of the first preformed opening 123 or second preformed opening 124 can be sized for use with a polarized U.S. style electrical plug where one prong is larger than another. The plurality of preformed openings (123, 124, 125) can be formed to allow insertion of a three-phase 220 volt electrical plug which typically have a differing electrical plug configuration to prevent use in typical 110 volt grounded electrical sockets.

To aid in the retention of the non-conductive plate 120 to an electrical plug, a plurality of preformed openings (123, 124, 125) can each have a portion of an interior surface that is incurvate with respect to the opening. The incurvate portion can allow frictional contact with the respective prongs of an electrical plug (see FIG. 4) to retain the plate 120, for example, against an electrical plug face. An adhesive can also be applied to the plate 120 to retain against the electrical plug face. Preferably, at least one portion of an opening is incurvate relative to the opening to aid in frictionally retaining the non-conductive plate 120 against the respective prongs of an electrical plug. Although the incurvate portion of a preformed opening (123, 124) is illustrated as being two opposing sides of a four-sided opening, the invention is not so limited. For example, only one side of a four-sided opening (123, 124) can be incurvate, without departing from the spirit of the invention. Although a gap is illustrated between the incurvate portions of the preformed openings shown (123, 124), the incurvate surface of a preformed opening can contact another portion of a surface of the preformed opening. Although not shown, the preformed opening 125 can have an incurvate portion, for example, where the opening is illustrated as being non-rounded. A preformed opening can be formed by formed into the non-conductive plate 120 by any means known in the art, for example, by cutting, stamping, or molding. The embodiment of FIG. 1 is preferably utilized with a typical U.S. twin socket wall outlet, so that a portion of the non-conductive plate 120 does not impede access to the adjacent socket.

Figure 2:
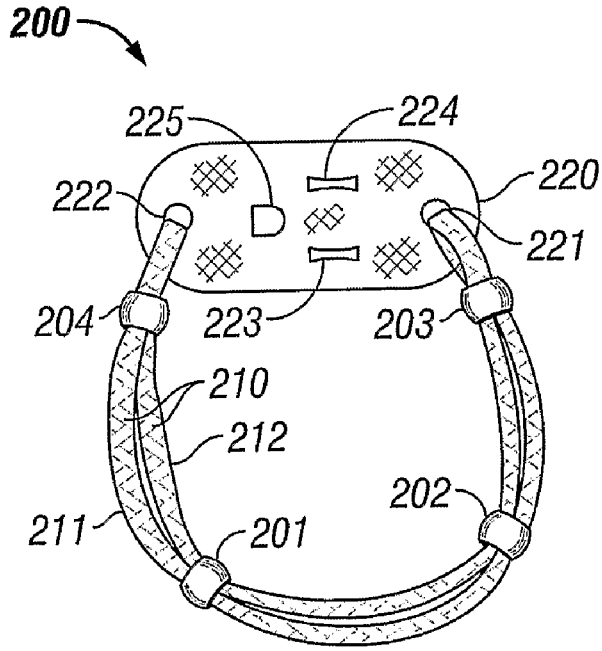
FIG. 2 is a perspective view of one embodiment of the present invention fabricated with a strap attached to a thin non-conductive plate disclosing a differing orientation of electrical prong openings formed in the plate.

FIG. 2 shows another embodiment of the invention 200 wherein a plurality of preformed openings (223, 224, 225) are in an alternative configuration still providing force on the plug sufficient to remove it from the socket. For example, one of each of the embodiments of FIG. 1 and FIG. 2 can be disposed over a plurality of respective prongs of an electrical plug connected to the socket of an extension cord. In such fashion, each strap (110, 210) can be pulled in opposite directions to allow removal of the electrical plug from the socket. This can also be preformed using two of the same embodiment without departing from the spirit of the invention.

Referring again to FIG. 1, the invention can have a slidable body (101, 102, 103, 104) with a longitudinal bore. A plurality of slidable bodies are not required. A slidable body, can be a bead (101, 102, 103, 104) as shown, but is not so limited. A slidable body, if present, can serve a plethora of purposes. A slidable body (101, 102, 103, 104) with a longitudinal bore can aid in holding the strap 110 in an overlapping state as discussed above. A slidable body can aid in supporting a power cord as discussed below in reference to FIG. 4.

A slidable body (101, 102, 103, 104) can be disposed over the adjacent sections (111, 112) of the strap 110 by any means known in the art. For example, one method of forming the embodiment shown includes disposing a non-joined section of strap 110 through the longitudinal bore of a first 101, second 102, third 103, and fourth 104 slidable body. A first end of the strap 110 is then disposed through a first aperture 121 in the plate 120 and second end of the strap 110 is then disposed through a second aperture 122 in the plate 120. The first and second ends of the strap 110 are then disposed back through the longitudinal bores of the first 101, second 102, third 103, and fourth 104 slidable bodies and the first and second ends of the strap 110 can then be connected to form a continuous loop. The longitudinal bore of the slidable body (101, 102, 103, 104) preferably has an inner diameter sized to allow the passage of both the first 111 and second 112 sections of the strap 110. The fit between the overlapping sections (111, 112) and the longitudinal bore of a slidable body (101, 102, 103, 104) can allow the slidable body to slide when a desired level of force is applied, but sufficient to retain the slidable body in place up to a desired level of force. The friction fit between the slidable body (101, 102, 103, 104) and the strap 110 can thus inhibit movement therebetween. For example, one slidable body 103 can be slidably disposed adjacent to the first aperture 121 to retain an end of the continuous loop 110 against the non-conductive plate 120.

Figure 3:
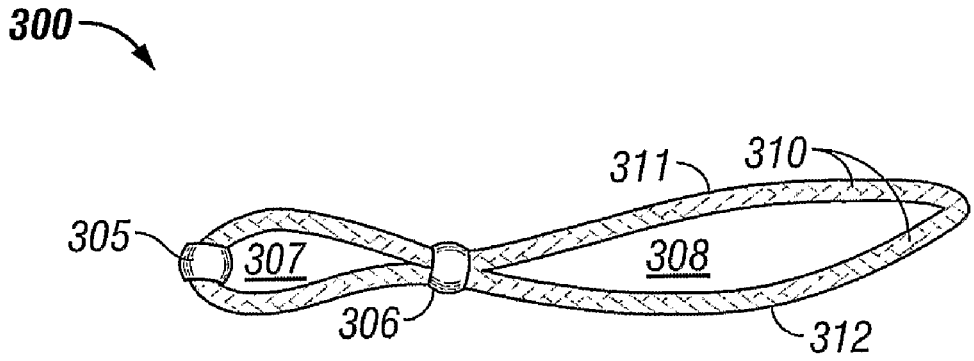
FIG. 3 is a perspective view of a second strap used to aid in identifying a power cord, according to one embodiment of the invention.

Further, a slidable body (101, 102, 103, 104) can aid in the identification of a power cord. A colored or different style of exterior, for example, rectangular, slidable body can allow a user to identify a power cord or an appliance connected to said cord, as many power cords appear similar. Braille characters can be added to allow identification of the electrical plug by the visually impaired. To further aid in the identification of a power cord connected to an electrical plug, an optional identification strap 300 can be used, as shown in FIG. 3. Identification strap 300 can be formed of the same materials as the strap (110, 210, 410) of an apparatus (100, 200, 400) for removing an electrical plug from a socket or may be formed from a dissimilar material. The identification strap 300 shown has two slidable bodies (305, 306) with longitudinal bores therethrough, but the invention is not so limited. A single slidable body (305 or 306) can be used without departing from the spirit of the invention. The slidable bodies (305, 306) of the identification strap 300 can be the same color or style of exterior, for example, rectangular, as the slidable bodies (101-104; 201-204; 401-404) of the apparatus (100, 200, 400) for removing an electrical plug from a socket. The identification strap 300 can then be disposed on a portion of the power cord to allow identification. The identification strap 300 can be disposed on an end of the power cord opposite from the electrical plug to aid in identification.

Although only one slidable body 305 is shown with the strap 310 extending therethrough, more than one can be used. For example, a third slidable body (not shown) can be disposed on the strap 310, opposite of slidable body 305 to keep slidable body 306 from sliding off of the strap 310. Slidable body 306, if used, can allow a power cord (not shown) to be disposed through one or both of the loops (307, 308). The slidable body 306 can then be slidably disposed adjacent the exterior surface of the power cord to retain the strap 310 at a desired location. As previously discussed, the frictional fit between the longitudinal bore of the slidable body 306 and the first 311 and second 312 sections of the strap 310 can retain the strap 310 in a desired location on the power cord. To form the identification strap 300 illustrated in FIG. 3, one can dispose a non-joined section of strap 310 through the longitudinal bore of slidable body 305, then both sections (311, 312) of the strap 310 can be disposed through the longitudinal bore of slidable body 306. An optional third slidable body can be disposed on one section (311 or 312) of the strap 310. Both sections (311, 312) of the strap 310 are then joined to form a continuous loop.

FIG. 4 illustrates an embodiment of an apparatus 400 for removing an electrical plug from a socket disposed on an electrical plug 440 connected to a power cord 430. This embodiment provides two cooperative elements: 1) a thin non-conductive plate 420 that fits between an electrical plug 440 and a socket (not shown); and 2) a strap 410 connected to the plate 420 through apertures (421, 422) fashioned on opposing lateral edges of the non-conductive plate 420. To use, a plurality of prongs, shown as but not limited to a standard U.S. style electrical plug 440 with two flat blades (443, 444) and a ground pin 445, are inserted through a plurality of respective preformed openings (423, 424, 425) in said non-conductive plate 420. The electrical plug 440 can then be disposed within a socket (not shown). To remove the electrical plug 440, the strap 410 can be grasped by a person to exert axial force on an electrical plug 440 to allow removal from a socket. The presence of the strap 410 permits removal of the electrical plug 440 by feeble or infirm individuals who lack the finger or hand strength to firmly grasp the electrical plug 440 body to exert sufficient axial force on the plug to disconnect from a socket. The strap 410 allows a feeble or infirm individual to use the large muscles of the arm to extract a plug 440 frictionally retained within a socket.

Optionally, the power cord 430 can be disposed through a gap between the sections (411, 412) of strap 410. The strap 410 can also provide slidable bodies (401, 402, 403, 404) with a longitudinal bore which can be disposed to provide an opening to allow the power cord 430, and connected electrical plug 440, to be inserted through strap 410. One or more of the slidable bodies (401, 402, 403, 404) can then be slidably displaced adjacent an exterior surface of the power cord 430.

Displacing at least one slidable body (401, 402, 403, 404) adjacent the power cord 430 can allow the strap 410 to remain at a given position along the power cord 430. This can be desirable for holding the strap 410 in a readily accessible orientation when a user reaches for the electrical plug 440 or an adjacent portion of the power cord 430. Further, the embodiment shown in FIG. 4 can be used to hold the strap 410 away from a socket face plate (not shown). A strap 410 can be longer than the strap illustrated to allow disconnection of the electrical plug 440 from a socket (not shown) where access to the socket is impeded. For example, a socket can be behind a desk or other object and thus difficult to access, the strap 410 can allow a user the convenience of pulling on an easily accessible portion of the power cord 430, yet by applying force to the strap 410, the force is transmitted to the face of the electrical plug 440 instead of the typically weak union of power cord 430 and electrical plug 440. Two slidable bodies (401, 402) can be used to retain the strap 410 at a desired location on the power cord 430 if so desired.

In addition to holding the strap 410 in a readily accessible orientation, a slidable body (401, 402, 403, 404) can be utilized to provide support for the power cord 430, depending on the strength of the non-conductive plate 420 and the frictional interaction of the exterior of the power cord 430, the first 411 and second 412 sections of the strap 410, and/or the slidable bodies (401, 402) used. Supporting the power cord 430 can control the stress experienced at the union of the power cord 430 and electrical plug 440 connected thereto. Although four slidable bodies (401, 402, 403, 404) are present in the illustrated embodiment, a single slidable body can be used without departing from the spirit of the invention. The embodiment shown in FIG. 4 further discloses the use of a second set of slidable bodies (403, 404). These slidable bodies (403, 404) can be disposed adjacent to an aperture (421, 422) to retain an end of the continuous loop 410 against the non-conductive plate 420.

Numerous embodiments and alternatives of the present invention have been disclosed. While the above disclosure includes what is believed to be the best mode for carrying out the invention, as contemplated by the inventor, not all possible alternatives have been disclosed. For that reason, the scope and limitation of the present invention is not to be restricted to the above disclosure, but is instead to be defined and construed by the appended claims.

What is claimed is:

1. An apparatus for removing an electrical plug from a socket comprising:

a non-conductive plate having a first aperture adjacent a first lateral edge of the plate, a second aperture adjacent an opposing second lateral edge of the plate, and a plurality of preformed openings for insertion of a plurality of respective prongs of the electrical plug through the non-conductive plate; and a strap disposed through the first and the second aperture forming a continuous loop, a first section and a second section of the strap each extending between the first aperture and the second aperture and lying adjacent along substantially an entire length of the strap.

2. The apparatus of claim 1 wherein a length of the first section of the strap and a length of the second section of the strap are substantially equal.

3. The apparatus of claim 1 wherein the first and the second sections of the strap lie adjacent along substantially the entire length of the strap when the non-conductive plate is disposed between the electrical plug and the socket.

4. The apparatus of claim 1 wherein the strap is a flexible, non-conductive strap with a circular cross-section.

5. The apparatus of claim 1 wherein at least one of the preformed openings comprises a four-sided opening with at least one side being incurvate relative to the four-sided opening.

6. The apparatus of claim 1 wherein at least one of the preformed openings comprises a four-sided opening with at least one set of opposing sides being incurvate relative to the four-sided opening.

7. The apparatus of claim 1 wherein at least one of the preformed openings comprises a multiple-sided opening with at least one side being incurvate with respect to the multiple-sided opening.

8. The apparatus of claim 1 further comprising at least one slidable body with a longitudinal bore, the first and the second sections of the strap extending through the longitudinal bore.

9. The apparatus of claim 8 wherein the at least one slidable body is at least one colored bead with a longitudinal bore.

10. The apparatus of claim 1 further comprising:

a power cord with a first end and a second end having the electrical plug connected thereto, the plurality of respective prongs of the electrical plug disposed through the non-conductive plate and the power cord disposed between the first and the second sections of the strap; and a first slidable body with a longitudinal bore disposed adjacent an exterior surface of the power cord and a second slidable body with a longitudinal bore disposed adjacent an opposing exterior surface of the power cord, the first and the second sections of the strap extending through the longitudinal bore of the first slidable body and the longitudinal bore of the second slidable body.

11. The apparatus of claim 10 further comprising a third slidable body with a longitudinal bore and a fourth slidable body with a longitudinal bore, the first and the second sections of the strap extending through the longitudinal bore of the third slidable body and the longitudinal bore of the fourth slidable body, the third slidable body disposed adjacent the first aperture of the non-conductive plate and the fourth slidable body disposed adjacent the second aperture of the non-conductive plate.

12. The apparatus of claim 11 further comprising:

a second strap forming a continuous loop disposed around the power cord between the first end and the second end, the second strap extending through a longitudinal bore of a fifth slidable body and a first and a second section of the second strap extending through a longitudinal bore of a sixth slidable body.

13. The apparatus of claim 12 wherein an exterior surface of the first, the second, the third, the fourth, the fifth, and the sixth slidable body are similarly colored to aid in identifying the power cord.

14. The apparatus of claim 10 further comprising:

a second strap forming a continuous loop disposed around the power cord between the first end and the second end, the second strap extending through a longitudinal bore of a fifth slidable body and a first and a second section of the second strap extending through a longitudinal bore of a sixth slidable body.

15. The apparatus of claim 14 wherein the second strap is disposed adjacent the first end of the power cord.

16. The apparatus of claim 14 wherein the sixth slidable body is disposed adjacent an exterior surface of the power cord to retain the second strap at a desired location on the power cord.

17. The apparatus of claim 14 wherein an exterior surface of the first, the second, the fifth, and the sixth slidable body are similarly colored to aid in identifying the power cord.

* * * * *